US007393620B2

(12) United States Patent
Kim

(10) Patent No.: US 7,393,620 B2
(45) Date of Patent: Jul. 1, 2008

(54) TONER COMPOSITION

(75) Inventor: Sang-deok Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 311 days.

(21) Appl. No.: 11/229,522

(22) Filed: Sep. 20, 2005

(65) Prior Publication Data

US 2006/0068311 A1 Mar. 30, 2006

(30) Foreign Application Priority Data

Sep. 24, 2004 (KR) ..... 10-2004-0077186

(51) Int. Cl.
*G03G 9/08* (2006.01)

(52) U.S. Cl. ..... 430/108.11; 430/108.7; 430/108.4

(58) Field of Classification Search ..... 430/108.7, 430/108.11, 108.4
See application file for complete search history.

(56) References Cited

U.S. PATENT DOCUMENTS 5,066,558 A * 11/1991 Hikake et al. ..... 430/108.7
5,378,572 A * 1/1995 Akiyama et al. ..... 430/108.7
6,177,221 B1 * 1/2001 Maniar et al. ..... 430/111.3
6,589,701 B2 * 7/2003 Yamazaki et al. ..... 430/106.2
2003/0129510 A1 * 7/2003 Hagi et al. ..... 430/108.7
2005/0214668 A1 * 9/2005 Miyakawa et al. ..... 430/108.7

FOREIGN PATENT DOCUMENTS

| | | |
|---|---|---|
| JP | 63-254465 | 10/1988 |
| JP | 08-030021 | 2/1996 |
| JP | 2003-202702 | 7/2003 |
| KR | 1999-068188 | 8/1999 |
| KR | 2002-0010112 | 2/2002 |
| KR | 2002-0094458 | 12/2002 |
| KR | 10-0377702 | 3/2003 |
| KR | 1020030068889 | 8/2003 |

OTHER PUBLICATIONS

Abstract of Korean Patent Laid-open No. 1999-0068188 dated Aug. 25, 1999 (one page).

* cited by examiner

*Primary Examiner*—Christopher RoDee
(74) *Attorney, Agent, or Firm*—Staas & Halsey LLP

(57) ABSTRACT

A toner composition includes toner particles containing a colorant, a binder, a charge control agent, a releasing agent, and an external additive containing silica, silicon carbide, magnesium stearate, and polyvinylidene fluoride. The toner composition of the present invention has a stable image density and no fogging/filming so that improved quality printing images may be provided.

18 Claims, 1 Drawing Sheet

TONER COMPOSITION

CROSS-REFERENCE TO RELATED APPLICATIONS

This application claims benefit under 35 U.S.C. § 119 from Korean Patent Application No. 2004-77186 filed on Sep. 24, 2004 in the Korean Intellectual Property Office, the disclosure of which is incorporated herein by reference.

BACKGROUND OF THE INVENTION

1. Field of the Invention

The present invention relates in general to a toner composition. More specifically, the present invention relates to a toner composition having an external additive with specific components that are present in a specific ratio, featuring stable charge distribution of the toner in a developer of an electrophotographic image forming apparatus, improved toner supply capability, prevention of filming and a fog, and high quality images.

2. Description of the Related Art

In recent years, electrophotographic image forming apparatuses such as laser printers, fax machines, and copiers have been widely used to obtain the benefit of high-speed operation and high quality images thereof. Depending on which kind of developer is used, the electrophotographic image forming apparatuses may be divided into a dry type and a wet type. Particularly, the embodiments of the present invention are related to a dry developer.

FIG. 1 is a schematic diagram of a conventional dry electrophotographic image forming apparatus based on a noncontact developing system. In the operational process of the dry electrophotographic image forming apparatus of FIG. 1, a photosensitive object (or photosensitive drum) 100 is charged by a charging device 600, and an image is exposed to a laser beam from a laser scanning unit 900 to develop a latent image on the surface of the photosensitive drum 100. A dry toner 400 in a supply roller 300 is supplied to a developing roller 200. A toner layer regulating device 500 ensures that the toner supplied to the developing roller 200 has a thin and uniform thickness. During this process the toner is frictionally charged by the contact between the developing roller 200 and the toner layer regulating device 500. Particularly, M/A and Q/M of the toner transferring to a developing area are adjusted. M/A is a measurement of weight of the toner per unit area (mg/cm$^2$), and Q/M is a measurement of amount of charge per unit weight of the toner (μC/g). Both M/A and Q/M of the toner are measured on the developing roller after the toner had passed through the toner layer regulating device. The toner, having passed through the regulating device 500, is then developed to an electrostatic latent image on the photosensitive drum 100, is transferred by a transfer roller (not shown) to a recording medium, and is fused by a fuser (not shown). Any residual toner on the photosensitive drum 100 is wiped by a cleaning blade 700, stored in the residual toner collecting bin 800, and the printing process is repeated again starting from the charging step to the image forming step.

In general, a dry toner contains a colorant, a binder, a control charge agent, a releasing agent, and optionally other additives to meet the functional requirements of the toner. The additives are divided into an internal additive that is added into toner particles, and an external additive that is added to the surface of the toner particles. Although the toner comprises particles of several micrometers that form a print image on the recording medium, chargeability and fluidity of the toner play a major factor in determining the quality of the print image. Therefore, various kinds of compounds are present in the toner composition as external additives to provide the toner with effective fluidity, charge stability (or chargeability), and cleanability.

A noncontact and nonmagnetic one-component developing system is regarded as very advantageous because the system features a—minimized size, facilitated color correspondence, effective gradation, and high-resolution image quality. The most important feature in the noncontact, nonmagnetic one-component developing system is ensuring that the charge and charge distribution of the toner remain constant after repeated print operation, that is, are substantially the same as in an initial printing operation. In this way, stable developing capacity may be maintained, and fogging and filming may be prevented.

The most effective way to provide the toner with a uniform charge is generally the formation of a thin toner layer on the developing roller. However, when the layer is made thin, it consequently imparts substantial stress to the toner and deteriorates the toner itself. In addition, when the thin toner layer is formed on the developing roller, the charge of the toner is increased, and this, in turn, lowers the developing efficiency and the image density.

SUMMARY OF THE INVENTION

Therefore, in an aspect of the present invention, a toner composition has an external additive in a specific ratio, featuring stabilized charge distribution of the toner despite the changes in printing environment and sequential histological changes caused by repeated printing operations for an extended period of time, prevention of filming and a fog, and improved quality images.

To achieve the above aspects and/or advantages, a toner composition includes: toner particles having a colorant, a binder, a charge control agent, a releasing agent, and an external additive containing silica, silicon carbide, magnesium stearate, and polyvinylidene fluoride.

Preferably, the content of the silica is in a range from about 0.2 wt. % to about 8.0 wt. % out of 100 wt. % of the toner particles; the content of the silicon carbide is in a range from about 0.1 wt. % to about 3.0 wt. % out of 100 wt. % of the toner particles; the content of the magnesium stearate is in a range from about 0.1 wt. % to about 4.0 wt. % out of 100 wt. % of the toner particles; and the content of the polyvinylidene fluoride is in a range from about 0.1 wt. % to about 2.0 wt. % out of 100 wt. % of the toner particles.

In the exemplary example, if a primary particle size of the silica microparticles is in a range from about 5 nm to about 20 nm, the content of silica microparticles is in a range from about 0.1 wt. % to about 4.0 wt. % out of 100 wt. % of the toner particles; and if a primary particle size of the silica macroparticles is in a range from about 30 nm to about 200 nm, the content of silica macroparticles is in a range from about 0.1 wt. % to about 4.0 wt. % out of 100 wt. % of the toner particles.

Preferably, a primary particle size of the silicon carbide is in a range from about 500 nm to about 1000 nm.

Preferably, the silicon carbide is β phase silicon carbide.

Preferably, a primary particle size of the magnesium stearate is in a range from about 1000 nm to about 2500 nm.

The polyvinylidene fluoride features a fusion point between about 140° C. and about 170° C., a melt viscosity between about 2000 Pa·S and about 4000 Pa·S, and an MFR between about 0.01 and about 0.1 at about 230° C. and about 2.16 Kgs.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawing of which.

DETAILED DESCRIPTION OF THE PREFERRED EMBODIMENTS

Figure 1:
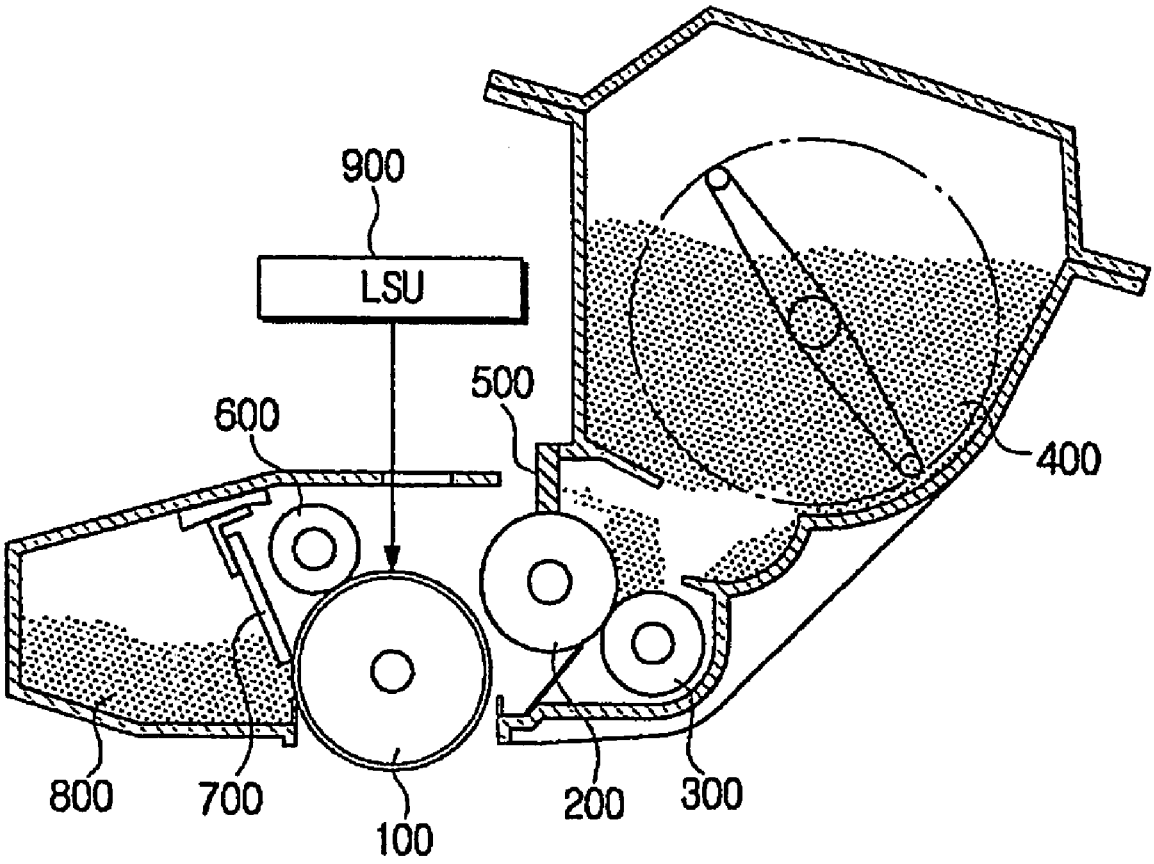
FIG. 1 (PRIOR ART)
FIG. 1 is a schematic diagram of a conventional art electrophotographic image forming apparatus.

Reference will now be made in detail to the embodiments of the present invention, examples of which are illustrated in the accompanying drawing, wherein like reference numerals refer to the like elements throughout. The embodiments are described below to explain the present invention by referring to the figure.

A toner composition according to an embodiment of the present invention includes toner particles that include a colorant, a binder, a charge control agent, a releasing agent, and an external additive.

Colorants embody colors of toner particles and are largely divided into dye colorants and pigment colorants. In general, any commercially used colorant may be employed as the colorant for the present invention toner composition. However, the pigment colorants, compared to the dye colorants, have an excellent thermal stability and lightproofness, and thus, are used more often as toner colorants.

Examples of the pigment colorants for use in the toner composition comprise organic pigments including azo pigments, phthalocyanine pigments, basic dyes, quinacridone pigments, dioxazine pigments, and diazo pigments; inorganic colored pigments including chromates, ferrocyanides, oxides, selenium sulfide, sulfates, silicates, carbonates, phosphates, and metal powder; and block inorganic pigments including carbon black. These examples may be used alone or in combination, and they are for illustrative purposes only.

Preferably, the content of the colorant in the toner composition of the present invention is in a range from about 1 wt. % to about 10 wt. % out of 100 wt. % of toner particles.

Examples of binder for use in the toner composition include homopolymers of styrene or substituted styrenes such as polystyrene, polyvinyltoluene; styrene-based copolymers such as styrene-acrylate copolymer; and polyethylene, polypropylene, polyvinyl chloride, polyacrylate, polymetacrylate, polyester, polyacrylonitrile, melamin resin, and epoxy resin. These polymers may be used alone or in combination, and they are for illustrative purposes only.

Preferably, the content of the binder resin in the toner composition is in a range from about 80 wt. %—about 98 wt. % out of 100 wt. % of toner particles.

The charge control agent is added to control the amount of charge introduced to toner particles. It is also used as an electric charge regulator or charge regulator. Depending on which charge, positive (+) or negative (−), a toner particle is, different kinds of the charge control agent are added.

Examples of the negative charge control agent include azo pigments containing chrome, and salicylic acid metal compounds containing chrome, iron, or zinc. Examples of the positive charge control agent include nigrosine, quarternary ammonium salt, and triphenylmethane derivatives.

Specifically, commercial examples of the charge control agent in the toner composition include NIGROSINE N01, NIGROSINE EX, BONTRON S-34 and BONTRON E-84, which are manufactured by ORIENT CHEMICAL INDUSTRIES CO., LTD., and AIZEN SPILON BLACK TRH and T-77, which are manufactured by, HODOGAYA CHEMICAL CO., LTD.

Preferably, the content of the charge control agent in the toner composition is in a range from about 0.1 wt. % to about 10 wt. % out of 100 wt. % of toner particles.

The releasing agent is usually added as an internal additive to the toner composition. Particularly, the releasing agent is used to facilitate the release of a roller from the toner when a toner image is transferred onto a recording medium, and thus, to prevent a toner offset. The recording medium tends to adhere to the roller because of the toner, so the recording medium may not be released properly. Thus, the releasing agent is added to give a neat and quick release between the roller and the toner.

Typical releasing agents are a polyolefin group having low molecular weight, a silicon group having a softening point by the application of heat, a fatty acid amid group, and wax. For the sake of convenience, waxes are generally used as the releasing agent.

Examples of the wax for use in the toner composition comprise natural waxes, including waxes from a plant, such as carnauba wax and bayberry wax, and waxes from an animal, such as beeswax, shellac wax, and spermacetti wax; mineral waxes including montan wax, ozokerite wax, and ceresin wax; petroleum based waxes including paraffin wax and microcrystalline wax; and synthetic waxes including polyethylene wax, polypropylene wax, acrylate wax, fatty acid amid wax, silicon wax, and polytetrafluoroethylene wax. These examples may be used alone or in combination, and they are for illustrative purposes only.

Preferably, the content of the wax in the toner composition is in a range from about 1 wt. % to about 10 wt. % out of 100 wt. % of toner particles.

The toner composition of the present invention contains an external additive in a specific ratio, in order to maintain the amount of charge and charge distribution of the toner, prevent filming and a fog, and maintain a certain level of developing efficiency. The external additive is prepared by mixing silica, silicon carbide, magnesium stearate, and polyvinylidene fluoride in a specific ratio.

Preferably, the content of silica in the external additive for use in the toner composition is in a range from about 0.2 wt. % to about 8.0 wt. % out of 100 wt. % of toner particles.

Originally silica was used as a desiccant, but depending on the size of a particle thereof, silica may also be used as the external additive. For example, if a primary particle size of silica is greater than about 30 nm, it is called a 'silica macroparticle', and if a primary particle size of particle is less than about 30 nm, it is called a 'silica microparticle'.

According to an embodiment of the present invention, the "primary particle" refers to a unit particle of a compound that is neither polymerized nor bound.

The silica microparticle is added mainly to improve fluidity of toner particles, and the silica macroparticle is added to give charge property to toner particles. Preferably, the silica microparticle and the silica macroparticle are mixed in a specific composition ratio. For instance, the content of the silica microparticle having a primary particle size between about 5 nm and about 20 nm ranges from about 0.1 wt. % to about 4.0 wt. %, and the content of the silica macroparticle having a primary particle size between about 30 nm to about 200 nm ranges from about 0.1 wt. % to about 4.0 wt. %. The size of the silica microparticle and the silica macroparticle contained in the external additive for the toner composition is determined on the basis of the size of the toner particle.

If the total content of silica is less than 0.2 wt. %, it is difficult to get effective fluidity and a desired charge property of the toner. On the other hand, if the total content of silica is greater than 8.0 wt. %, the charge property outweighs other properties, so that it becomes difficult to control the amount of charge given to the toner particles. Thus, the content of silica should be carefully determined, taking the above problems into consideration.

As described before, the external additive in the toner composition contains silicon carbide. Preferably, the content of silicon carbide is in a range from about 0.1 wt. % to about 3.0 wt. % out of 100 wt. % of toner particles.

Silicon carbide (SiC) is usually used as an abrasive, and has a net-shaped structure and effective strength and hardness. Also, silicon carbide has a substantially high melting point (higher than 2700° C.), and is sublimated at 2200° C. Silicon carbide is not soluble in water and acid, and is totally chemically inactive. Although silicon carbide is stable in aqua regia, it is also characterized by being slowly decomposed by alkali fusion. As an abrasive, silicon carbide is used in a rubstone, abrasive cloth, and wrap materials. It is also used for specific refractory materials, chemical reaction vessels, or resistive heat elements.

The major function of silicon carbide is to control an excessive charge property of the toner, given that the external additive is composed of silica only. Preferably, the size of a primary particle of silicon carbide is in a range from about 500 nm to about 1000 nm. Similar to silica, silicon carbide has a specific particle size that is determined based on the toner particle size and the compatibility with the toner.

The external additive also contains magnesium stearate. The content of magnesium stearate is in a range from about 0.1 wt. % to about 4.0 wt. % out of 100 wt. % of toner particles. Preferably, the size of a primary particle of magnesium stearate is in a range from about 1000 nm to about 2500 nm, wherein the range is carefully determined based on the toner particle size and the compatibility with the toner.

Meanwhile, background fouling occurs when the charge of the toner is low or the thin layer of the developing roller is thick. However, the background fouling may be overcome by adding magnesium stearate to the toner composition because magnesium stearate is effective for increasing the charge of the toner and reducing the thickness of the toner layer of the developing roller.

The external additive of the toner composition further includes polyvinylidene fluoride.

Typically, the external additive for the toner composition contained inorganic particles, but the external additive for the toner composition according to an embodiment of the present invention includes organic polyvinylidene fluoride. Polyvinylidene fluoride is one of piezoelectric and pyroelectric polymers that produce electricity whenever there is a change in pressure or temperature. Therefore, polyvinylidene fluoride is frequently used in heat detectors, infrared detectors, sound-wave detectors, microphones, and non-contact switches.

Particularly in the present invention polyvinylidene fluoride shows an opposite polarity to the toner's polarity, so it easily causes frictional electricity to the toner. Besides, polyvinylidene fluoride prevents the toner from aggregating to form clumps. Also, polyvinylidene fluoride protects magnesium stearate, one of components in the external additive. This is how the thickness of the toner layer of the developing roller may be adjusted.

Polyvinylidene fluoride used in the present invention features a fusion point between about 140° C. and about 170° C., a melt viscosity between about 2000 Pa·S and about 4000 Pa·S, and an MFR between 0.01 and about 0.1 at about 230° C. and about 2.16 Kgs.

Preferably, the content of polyvinylidene fluoride is in a range from about 0.1 wt. % to about 2.0 wt. % out of 100 wt. % of toner particles.

Therefore, the external additive for the toner composition is prepared by mixing silica, silicon carbide, magnesium stearate, and polyvinylidene fluoride in a specific ratio, to optimize the expected the toner composition's effect.

Besides the above-described external additive, the toner composition may further include other additives for improving its function. For example, a UV stabilizer, an antimold substance, a bactericide, an antistatic agent, a gloss modifier, an antioxidant, and an anti coagulation agent such as silane or silicon-modified silica particle may be added to the toner composition as part of the external additive or as an internal additive.

The following will now provide Examples and Comparative Examples.

EXAMPLES

Example 1

Preparation of Toner Particles (Toner with Negative Polarity Employing Pulverization Process)

The following components were mixed in a HENSCHEL mixer.

| | |
|---|---|
| Polystyrene | about 0.5 wt. % |
| Carbon black | about 5 wt. % |
| T-77 (manufactured by HODOGAYA CHEMICAL CO., LTD.) | about 2.5 wt. % |
| Polyethylene wax | about 2 wt. % |

The mixture was put into a twin extruder to be extruded, and heated to 130° C. The extruded mixture was cooled and coagulated. Next, the coagulated mixture was pulverized and classified in a pulverization classifier, and toner particles of an average diameter about 8 μm were prepared, prior to the addition of an external additive to the toner particles.

Preparation of Toner Composition

The following components were added as the external additive to the prepared toner particles.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Silicon carbide (primary particle size: about 500-about 1000 nm) | about 0.3 wt. % |
| Magnesium stearate (primary particle size: about 1000-about 2500 nm) | about 0.5 wt. % |
| Polyvinylidene fluoride | about 0.2 wt. % |

Comparative Example 1

Preparation of Toner Composition

The following components were added as the external additive to the prepared toner particles in Example 1.

Negatively charged silica (primary particle size: about 5-about 20 nm) about 1.0 wt. %

Negatively charged silica (primary particle size: about 30 about 200 nm) about 1.2 wt. %

Comparative Example 2

Preparation of Toner Composition

The following components were added as the external additive to the prepared toner particles in Example 1.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Silicon carbide (primary particle size: about 500-about 1000 nm) | about 0.3 wt. % |

Comparative Example 3

Preparation of Toner Composition

The following components were added as the external additive to the prepared toner particles in Example 1.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Silicon carbide (primary particle size: about 500-about 1000 nm) | about 0.3 wt. % |

Comparative Example 4

Preparation of Toner Composition

The following components were added as the external additive to the prepared toner particles in Example 1.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Magnesium stearate (primary particle size: about 1000-about 2500 nm) | about 0.5 wt. % |

Comparative Example 5

Preparation of Toner Composition

The following components were added as the external additive to the prepared toner particles in Example 1.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Silicon carbide (primary particle size: about 500-about 1000 nm) | about 0.3 wt. % |
| Calcium stearate (primary particle size: about 1000-about 2500 nm) | about 0.5 wt. % |
| Polyvinylidene fluoride | about 0.2 wt. % |

Comparative Example 6

Preparation of Toner Composition

The following components were added as the external additive to the prepared toner particles in Example 1.

| | |
|---|---|
| Negatively charged silica (primary particle size: about 5-about 20 nm) | about 1.0 wt. % |
| Negatively charged silica (primary particle size: about 30-about 200 nm) | about 1.2 wt. % |
| Silicon carbide (primary particle size: about 500-about 1000 nm) | about 0.3 wt. % |
| Zinc stearate (primary particle size: about 1000-about 2500 nm) | about 0.5 wt. % |
| Polyvinylidene fluoride | about 0.2 wt. % |

{Test}

Thusly prepared toner compositions from the Example 1 and Comparative Examples 1 through 6 were tested under the following developing conditions, and WERE compared to each other.

Developing Conditions

Surface potential ($V_O$): about −700 V

Latent potential ($V_L$): about −100 V

Applied voltage to developing roller: VP-P=about 1.8 KV, Frequency=about 2.0 kHz, Vdc=about −500 V, Duty ratio=about 35% (square wave)

Developing gap: about 150 about 400 μm

Developing Roller (1) Aluminum

Luminance: Rz=about 1-2.5 (after nickel plating)

(2) Rubber Roller (Nitrile Butadiene Rubber Roller)

Resistance: about $1\times10^5$ Ω-about $5\times10^5$ Ω

Hardness: about 50

Toner: Charge (Q/M)=about −5 to about −30 μC/g (after passing through the toner layer regulating device)

Weight of Toner=about 0.3-about 1.0 mg/cm$^2$.

Evaluation and Test Results

Printing images compared when the toner compositions from Example 1 and Comparative Examples 1 to 6 were used in a 20 ppm LBP printer, respectively. More specifically, image density, fog (background fouling, contamination in a non-image area), reproducibility, and filming of the photosensitive drum were measured for the performance evaluation of each toner composition. For the measurement of image, density the density of solid pattern on a paper was measured. For the measurement of fog, the density in a non-image area on the photosensitive drum was measured by employing the SPECTROEYE manufactured by GREGTAGMACBETH.

Image Density

In the following Table 1, '○' indicates that the image density was greater than 1.3; 'Δ' indicates that the image density was between 1.1 and 1.3; and 'X' indicates that the image density was less than 1.1.

TABLE 1

| No. of Paper sheets | Beginning | 1000 | 2000 | 3000 | 4000 | 5000 |
|---|---|---|---|---|---|---|
| Ex. 1 | O | O | O | O | O | Δ |
| Comp. 1 | O | O | O | O | O | Δ |
| Comp. 2 | O | O | O | O | O | Δ |
| Comp. 3 | O | O | O | O | O | Δ |
| Comp. 4 | O | O | O | O | O | Δ |
| Comp. 5 | O | O | O | O | O | Δ |
| Comp. 6 | O | O | O | O | O | Δ |

As shown Table 1, it is apparent that the image densities are all effective, even when the external additive for use with the toner composition contained silica only. Therefore, even in the case that the external additive contains only silica, the image density may be maintained at a certain level despite an immense amount of printing.

Fog

In the following Table 2, '○' indicates that the fog was less than 0.14; 'Δ' indicates that the fog was between 0.15 and 0.16; and 'X' indicates that the fog was greater than 0.17.

TABLE 2

| No. of Paper sheets | Beginning | 1000 | 2000 | 3000 | 4000 | 5000 |
|---|---|---|---|---|---|---|
| Ex. 1 | O | O | O | O | O | Δ |
| Comp. 1 | O | O | Δ | Δ | X | X |
| Comp. 2 | O | O | O | Δ | Δ | X |
| Comp. 3 | O | O | O | O | Δ | Δ |
| Comp. 4 | O | O | O | Δ | Δ | X |
| Comp. 5 | O | O | O | O | Δ | Δ |
| Comp. 6 | O | O | O | O | Δ | Δ |

As shown from Table 2, the toner composition in the Example 1 provided clear images, and fogging was minimized, even when the amount of printing was increased to some extent. Also, the Comparative Example 3 containing silicon carbide and polyvinylidene fluoride, and the Comparative Examples 5 and 6 containing calcium stearate and zinc stearate in replacement of magnesium stearate provided sharp printing images although the amount of printing was relatively substantial (for example, 4000 sheets). In contrast, the Comparative Example 1 containing only silica failed to provide sharp images because of the fog when the amount of printing exceeded 2000 sheets.

Therefore, the Example 1, which is the toner composition containing all components such as silica, silicon carbide, magnesium stearate, and polyvinylidene fluoride, was the most effective toner composition for providing sharp images despite an excessive or prolonged printing operation.

Producibility

In the following Table 3, '○' indicates that the producibility was superior; 'Δ' indicates that the producibility was fair; and 'X' indicates that the producibility was poor.

TABLE 3

| No. of Paper sheets | Beginning | 1000 | 2000 | 3000 | 4000 | 5000 |
|---|---|---|---|---|---|---|
| Ex. 1 | O | O | O | O | O | Δ |
| Comp. 1 | O | O | O | Δ | Δ | X |
| Comp. 2 | O | O | O | Δ | Δ | X |
| Comp. 3 | O | O | O | O | Δ | Δ |
| Comp. 4 | O | O | O | Δ | Δ | X |
| Comp. 5 | O | O | O | O | Δ | Δ |
| Comp. 6 | O | O | O | O | Δ | Δ |

As shown in Table 3, the Example 1, which is the toner composition containing all components such as silica, silicon carbide, magnesium stearate, and polyvinylidene fluoride, was the most effective toner composition, having a substantial producibility.

Filming

In the following Table 4, '○' indicates that no filming was occurred; 'Δ' indicates that filming was occurred but acceptable; and 'X' indicates that filming was occurred quite often.

TABLE 4

| No. of Paper sheets | Beginning | 1000 | 2000 | 3000 | 4000 | 5000 |
|---|---|---|---|---|---|---|
| Ex. 1 | O | O | O | O | O | Δ |
| Comp. 1 | O | O | Δ | X | X | X |
| Comp. 2 | O | O | Δ | X | X | X |
| Comp. 3 | O | O | O | Δ | Δ | X |
| Comp. 4 | O | O | Δ | X | X | X |
| Comp. 5 | O | O | O | O | Δ | Δ |
| Comp. 6 | O | O | O | O | Δ | Δ |

As shown in Table 4, the toner composition in the Example 1 was the most effective toner composition, having no filming despite an excessive or prolonged printing operation.

In conclusion, the toner composition containing the external additive consisting of silica, silicon carbide, magnesium stearate, and polyvinylidene fluoride in a specific ratio turned out to be the most effective toner composition, featuring a stable image density, superior producibility, and no fogging/filming.

The foregoing embodiment and advantages are merely exemplary and are not to be construed as limiting the present invention. The present teaching may be readily applied to other types of apparatuses. Also, the description of the embodiments of the present invention is intended to be illustrative, and not to limit the scope of the claims, and many alternatives, modifications, and variations will be apparent to those skilled in the art. Hence, it would be appreciated by those skilled in the art that changes may be made in these embodiments without departing from the principles and spirit of the invention, the scope of which is defined in the claims and their equivalents.

What is claimed is:

1. A toner composition comprising:

toner particles comprising a colorant, a binder, a charge control agent, and a releasing agent; and an external additive consisting essentially of silica, silicon carbide, magnesium stearate, and polyvinylidene fluoride, wherein a content of the silica is in a range from about 0.2 wt. % to about 8.0 wt. % out of 100 wt. % of the toner particles; a content of the silicon carbide is in a range from about 0.1 wt. % to about 3.0 wt. % out of 100 wt. % of the toner particles; a content of the magnesium stearate is in a range from about 0.1 wt. % to about 4.0 wt. % out of 100 wt. % of the toner particles; and a content of the polyvinylidene fluoride is in a range from about 0.1 wt. % to about 2.0 wt. % out of 100 wt. % of the toner particles.

2. The toner composition according to claim 1, wherein the silica includes silica microparticles and silica macroparticles, and if a primary particle size of the silica microparticles is in a range from about 5 nm to about 20 nm, a content of the silica microparticles is in a range from about 0.1 wt. % to about 4.0 wt. % out of 100 wt. % of the toner particles; and if a primary particle size of the silica macroparticles is in a range from about 30 nm to about 200 nm, a content of the silica macroparticles is in a range from about 0.1 wt. % to about 4.0 wt. % out of 100 wt. % of the toner particles.

3. The toner composition according to claim 1, wherein a primary particle size of the silicon carbide is in a range from about 500 nm to about 1000 nm.

4. The toner composition according to claim 1, wherein the silicon carbide is beta phase silicon carbide.

5. The toner composition according to claim 1, wherein a primary particle size of the magnesium stearate is in a range from about 1000 nm to about 2500 nm.

6. The toner composition according to claim 1, wherein the polyvinylidene fluoride has a fusion point between about 140° C. and about 170° C., a melt viscosity between about 2000 Pa·S and about 4000 Pa·S, and an MFR (melt flow rate) between about 0.01 and about 0.1 at about 230° C. and about 2.16 Kgs.

7. The toner composition according to claim 1, wherein a content of the colorant is in a range from about 1 wt. % to about 10 wt. % out of 100 wt. % of toner particles.

8. The toner composition according to claim 7, wherein the colorant is a pigment.

9. The toner composition according to claim 8, wherein the pigment is selected from the group consisting of azo pigments, phthalocyanine pigments, basic dyes, quinacridone pigments, dioxazine pigments, diazo pigments, chromates, ferrocyanides, oxides, selenium sulfide, sulfates, silicates, carbonates, phosphates, metal powder, and carbon black, alone or in combination.

10. The toner composition according to claim 1, wherein the binder is a binder resin, and a content of the binder resin is in a range from about 80 wt. %—about 98 wt. % out of 100 wt. % of toner particles.

11. The toner composition according to claim 10, wherein the binder is selected from the group consisting of polystyrene, polyvinyltolune, styrene-acrylate copolymer, polyethylene, polypropylene, polyvinyl chloride, polyacrylate, polymetacrylate, polyester, polyacrylonitrile, melamin resin, and epoxy resin, alone or in combination.

12. The toner composition according to claim 1, wherein a content of the charge control agent is in a range from about 0.1 wt. % to about 10 wt. % out of 100 wt. % of toner particles.

13. The toner composition according to claim 12, wherein the charge control agent is one of a positive charge control agent or a negative charge control agent, the negative charge control agent is selected from the group consisting of azo pigments, chrome, iron, and zinc, alone or in combination, and the positive charge control agent is selected from the group consisting of nigrosine, quarternary ammonium salt, and triphenylmethane derivatives, alone or in combination.

14. The toner composition according to claim 1, wherein the releasing agent is a wax, and a content of the wax in the toner composition is in a range from about 1 wt. % to about 10 wt. % out of 100 wt. % of toner particles.

15. The toner composition according to claim 14, wherein the wax is selected from the group consisting of carnauba wax, bayberry wax beeswax, shellac wax, spermacetti wax, montan wax, ozokerite wax, ceresin wax paraffin wax, microcrystalline wax, polyethylene wax, polypropylene wax, acrylate wax, fatty acid amid wax, silicon wax, and polytetrafluoroethylene wax, any of said waxes being selected alone or in combination.

16. A toner composition comprising:

toner particles comprising a colorant, a binder, a charge control agent, and a releasing agent; and an external additive consisting essentially of silica, silicon carbide, magnesium stearate, and polyvinylidene fluoride, wherein a primary particle size of the silicon carbide is in a range from about 500 nm to about 1000 nm.

17. A toner composition comprising:

toner particles comprising a colorant, a binder, a charge control agent, and a releasing agent; and an external additive consisting essentially of silica, silicon carbide, magnesium stearate, and polyvinylidene fluoride, wherein the silicon carbide is beta phase silicon carbide.

18. A toner composition comprising:

toner particles comprising a colorant, a binder, a charge control agent, and a releasing agent; and an external additive consisting essentially of silica, silicon carbide, magnesium stearate, and polyvinylidene fluoride, wherein a primary particle size of the magnesium stearate is in a range from about 1000 nm to about 2500 nm.

* * * * *

UNITED STATES PATENT AND TRADEMARK OFFICE

CERTIFICATE OF CORRECTION

PATENT NO. : 7,393,620 B2
APPLICATION NO. : 11/229522
DATED : July 1, 2008
INVENTOR(S) : Sang-deok Kim It is certified that error appears in the above-identified patent and that said Letters Patent is hereby corrected as shown below:

Column 11, Line 24, change "%—about" to --%-about--.

Column 11, Line 28, change "polyvinyltolune," to --polyvinyltoluene,--.

Column 11, Line 30, change "melamin" to --melamine--.

Column 12, Line 10, before "beeswax" insert --,--.

Column 12, Line 11, before "paraffin" insert --,--.

Column 12, Line 13, change "amid" to --amide--.

Signed and Sealed this

Twenty-eighth Day of October, 2008

JON W. DUDAS
*Director of the United States Patent and Trademark Office*